US011047273B2

(12) United States Patent
Okazaki et al.

(10) Patent No.: US 11,047,273 B2
(45) Date of Patent: Jun. 29, 2021

(54) OIL PAN

(71) Applicant: Suzuki Motor Corporation, Hamamatsu (JP)

(72) Inventors: Shotaro Okazaki, Hamamatsu (JP); Ryo Nagasawa, Hamamatsu (JP); Akira Osada, Hamamatsu (JP)

(73) Assignee: SUZUKI MOTOR CORPORATION

( * ) Notice: Subject to any disclaimer, the term of this patent is extended or adjusted under 35 U.S.C. 154(b) by 215 days.

(21) Appl. No.: 16/509,019

(22) Filed: Jul. 11, 2019

(65) Prior Publication Data

US 2020/0025046 A1 Jan. 23, 2020

(30) Foreign Application Priority Data

Jul. 17, 2018 (JP) ..... JP2018-134308

(51) Int. Cl.
*F01M 11/00* (2006.01)
*F01M 1/02* (2006.01)

(52) U.S. Cl.
CPC ..... *F01M 11/0004* (2013.01); *F01M 1/02* (2013.01); *F01M 2011/0066* (2013.01); *F01M 2011/0091* (2013.01)

(58) Field of Classification Search
CPC ..... F01M 11/0004; F01M 2011/0066; F01M 2011/0091; F01M 1/02
See application file for complete search history.

(56) References Cited

U.S. PATENT DOCUMENTS 3,354,988 A * 11/1967 Leonard ..... F01M 11/0004 184/6
3,817,354 A * 6/1974 Meiners ..... F01M 11/0004 184/104.3
5,653,303 A * 8/1997 Kawamoto ..... F01M 11/0004 180/219
8,713,923 B2 * 5/2014 Morita ..... F01N 13/008 60/313
2005/0081815 A1 * 4/2005 Ohta ..... F01M 11/0004 123/195 C
2008/0156560 A1 7/2008 Shiozaki et al.

FOREIGN PATENT DOCUMENTS

JP 2008163840 A 7/2008

* cited by examiner

*Primary Examiner* — Syed O Hasan
(74) *Attorney, Agent, or Firm* — Lerner, David, Littenberg, Krumholz & Mentlik, LLP

(57) ABSTRACT

An oil pan disposed underneath an engine of a motorcycle and configured to reserve engine oil includes a shallow bottom portion and a deep bottom portion formed to extend in a front-rear direction of the motorcycle substantially at a center in a left-right direction of the motorcycle of the shallow bottom portion, and to become deeper than the shallow bottom portion, and in which a space defined in the left-right direction of the motorcycle between both side wall portions of the deep bottom portion that face each other in the left-right direction of the motorcycle is formed to increase as the deep bottom portion extends from a front toward a rear thereof with respect to the motorcycle.

4 Claims, 7 Drawing Sheets

OIL PAN

CROSS-REFERENCE TO RELATED APPLICATIONS

This application claims the benefit of the filing date of Japanese Patent Application No. 2018-134308, filed on Jul. 17, 2018, the disclosure of which is hereby incorporated herein by reference.

BACKGROUND OF THE INVENTION

Technical Field

The present invention relates to an oil pan disposed underneath an engine of a motorcycle.

Background Art

Japanese Patent Publication JP2008-163840A discloses an oil pan in which a plurality of ribs, aligned in a front-rear direction of a motorcycle, are provided on a bottom portion thereof in such a manner as to project therefrom. A drain hole is provided on a bottom portion of the oil pan.

BRIEF SUMMARY OF THE INVENTION

Problem to be Solved by the Invention

Among components provided around an engine of a motorcycle, an oil pan is used in a high-temperature environment. Running air hardly flows on, in particular, a rear portion of the oil pan that is located toward the rear of the motorcycle while the motorcycle is running, causing a problem in that it becomes difficult to cool the particular portion of the oil pan using running air. In view of these situations, an object of the present invention is to efficiently cool, using running air, a rear portion of an oil pan that is located toward the rear of a motorcycle.

Means for Solving the Problem

To achieve the object, an oil pan disposed underneath an engine of a motorcycle and configured to reserve engine oil, includes a shallow bottom portion, and a deep bottom portion formed to extend in a front-rear direction of the motorcycle substantially at a center in a left-right direction of the motorcycle of the shallow bottom portion and to become deeper than the shallow bottom portion and in which a space defined in the left-right direction of the motorcycle between both side wall portions of the deep bottom portion that face each other in the left-right direction of the motorcycle is formed to increase as the deep bottom portion extends from a front toward a rear thereof with respect to the motorcycle.

Advantageous Effect of Invention

According to the present invention, the rear portion of the oil pan that is located toward the rear of the motorcycle can be cooled efficiently using running air.

DETAILED DESCRIPTION

Figure 1:
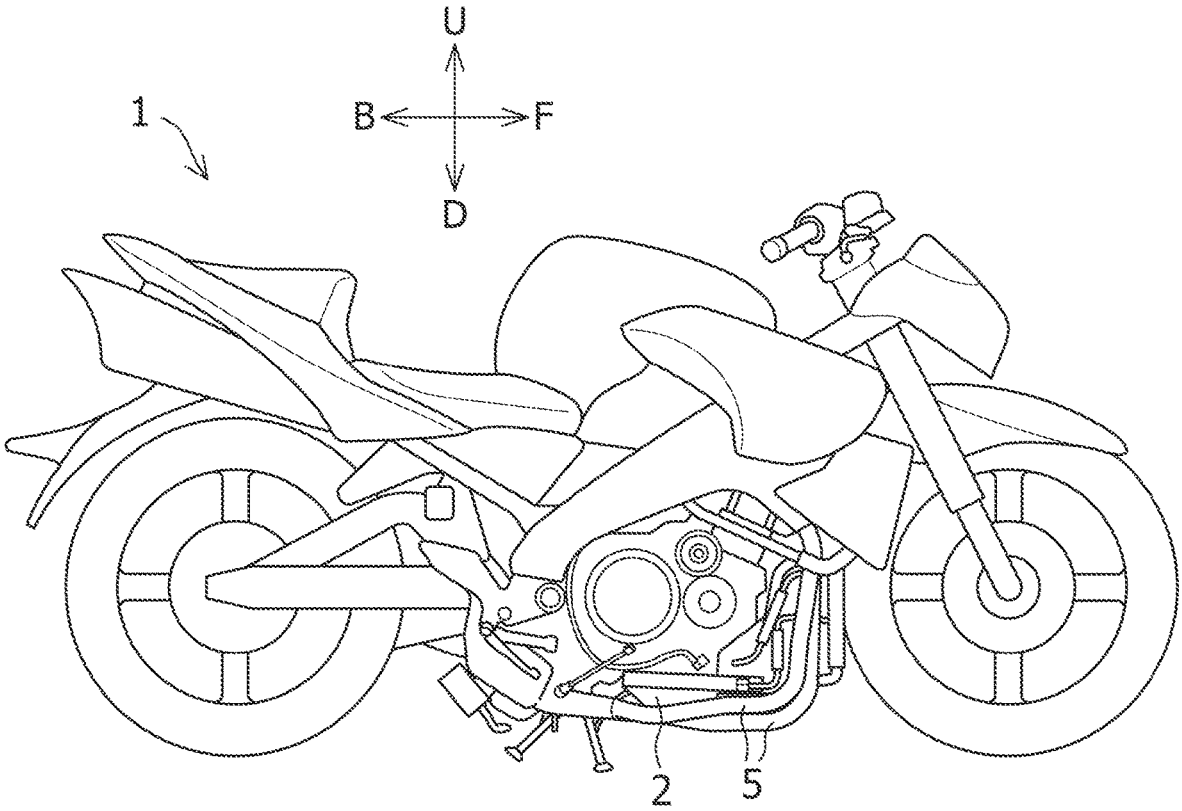
FIG. 1 is a side view of a motorcycle.
Figure 2:
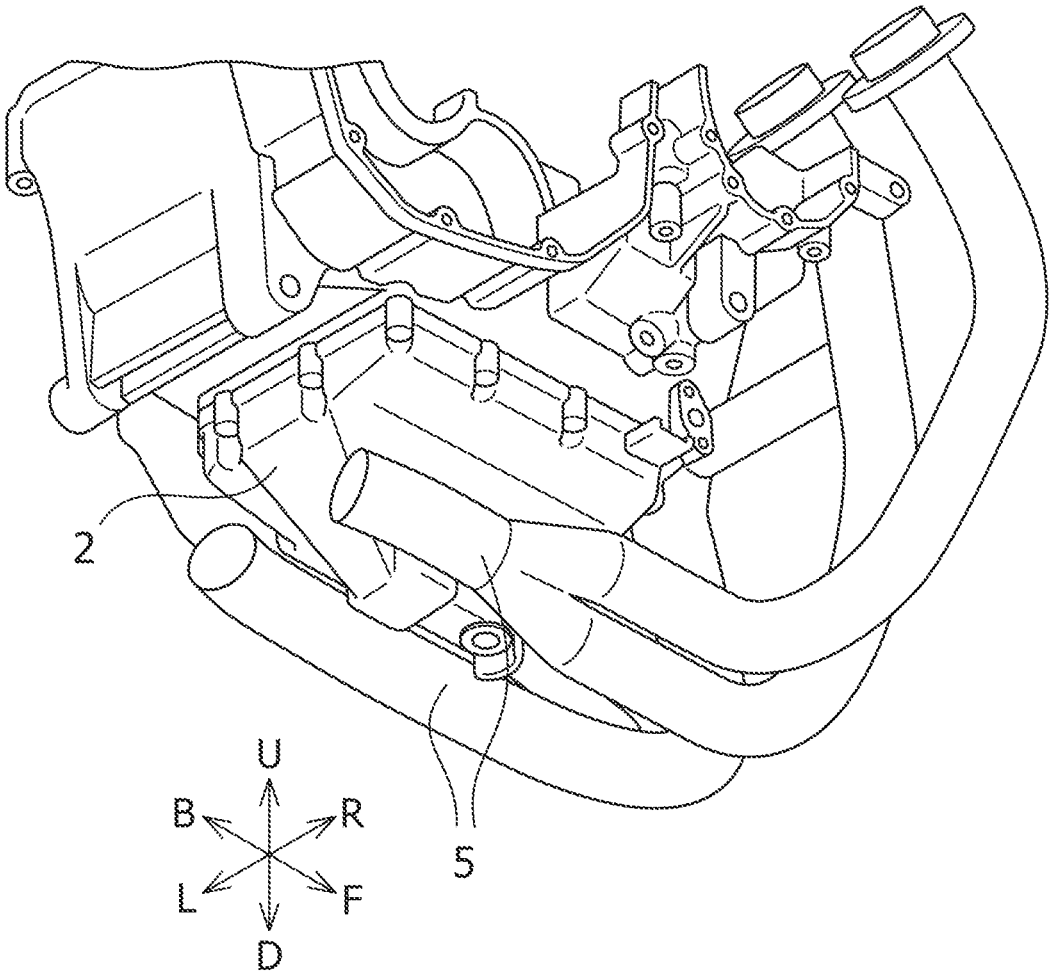
FIG. 2 is a perspective view of a portion underneath an engine of the motorcycle as viewed from below the motorcycle.

Hereinafter, an embodiment of the present invention will be described. However, the present invention is not limited by the following embodiment. In the drawings, arrows F and B denote a front of a motorcycle and a rear of the motorcycle, respectively, arrows L and R denote a leftward direction of the motorcycle and a rightward direction of the motorcycle, respectively, with reference to the front of the motorcycle, and arrows U and D denote an upward direction of the motorcycle and a downward direction of the motorcycle, respectively.

As illustrated in FIGS. 1 to 7, an oil pan 2, configured to reserve engine oil, is provided underneath an engine of a motorcycle 1. This oil pan 2 includes a shallow bottom portion 3 and a deep bottom portion 4. An opening portion of the shallow bottom portion 3 itself forms an opening portion of the oil pan 2.

Figure 7:
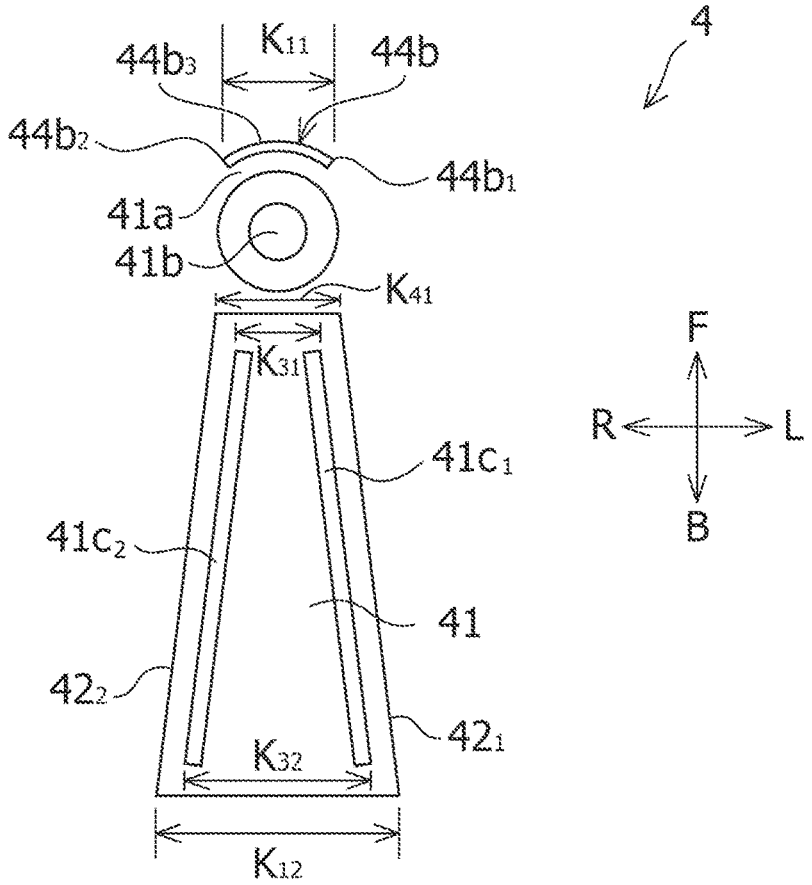
FIG. 7 is an explanatory view illustrating a bottom wall portion of a deep bottom portion of the oil pan.

The deep bottom portion 4 is formed to extend in a front-rear direction of the motorcycle substantially at a center in the left-right direction of the motorcycle of the shallow bottom portion 3 and to be deeper than the shallow bottom portion 3 and has a substantially rectangular shape when seen from above. A bottom wall portion 41 of the deep bottom portion 4 is located further downwards of the motorcycle than a bottom wall portion 31 of the shallow bottom portion. A space in the left-right direction of the motorcycle between a left side wall portion $\mathbf{42}_1$ and a right side wall portion $\mathbf{42}_2$ of the deep bottom portion 4 that face each other in the left-right direction of the motorcycle increases as the deep bottom portion 4 extends from a front end toward a rear end thereof. Specifically, the space $K_{12}$ toward the rear with respect to the motorcycle is greater than the space $K_{11}$ at the front thereof with respect to the motorcycle (FIG. 7). When referred to herein, "substantially the center" is not necessarily limited strictly to a center, and it means and includes a scope allowing design change based on the technical idea of the present invention.

A front wall portion 44, which is located at a front portion of the deep bottom portion 4 and is contiguous with the bottom wall portion 41, as well as the left side wall portion $\mathbf{42}_1$ and the right side wall portion $\mathbf{42}_2$, includes an upper wall surface portion 44*a* and a lower wall portion 44*b* with respect to the motorcycle. The lower wall surface portion 44*b* is formed substantially into an arc shape when seen from below in such a manner that both end portions $\mathbf{44}b_1$ and $\mathbf{44}b_2$ thereof in the left-right direction of the motorcycle are located further rearwards towards the rear of the motorcycle than a substantially central portion $\mathbf{44}b_3$ thereof in the left-right direction of the motorcycle. When referred to herein, "substantially an arc shape" means not only an arc of a true circle but also a curvilinear shape including part of an ellipse or an oval, and may not necessarily be an arc shape, and it may be a shape in which part of an arc shape is replaced by a rectilinear shape.

In the bottom wall portion 41 of the deep bottom portion 4, a recess portion 41*a* having a shape recessed inwards of the oil pan is formed at the rear of the lower wall surface portion 44*b* of the front wall portion 44. An engine oil discharge port is formed in this recess portion 41*a*, and a bolt 41*b* is fastened into the discharge port. The lower wall surface portion 44*b* is formed into a rib-like shape that protrudes downwards of the motorcycle as a result of the recess portion 41*a* being formed.

On an outer wall surface of the bottom wall portion 41 of the deep bottom portion 4, two rib portions $\mathbf{41}c_1$ and $\mathbf{41}c_2$ are provided at the rear of the recess portion 41*a* while being spaced apart from each other in the left-right direction of the motorcycle, the two rib portions $\mathbf{41}c_1$ and $\mathbf{41}c_2$ protruding downwards of and extending in the front-rear direction of the motorcycle. A space between both the rib portions in the left-right direction of the motorcycle increases as the rib portions extend from a front toward a rear thereof with respect to the motorcycle. Specifically, the space $K_{32}$ at the rear with respect to the motorcycle is greater than the space $K_{31}$ at the front thereof (FIG. 7).

The bottom wall portion 31 of the shallow bottom portion 3 is provided in such a manner as to be contiguous with the left side wall portion $\mathbf{42}_1$ of the deep bottom portion 4 and a left side wall portion 35 of the shallow bottom portion and is provided in such a manner as to be contiguous with right side wall portion $\mathbf{42}_2$ of the deep bottom portion 4 and a right side wall portion of the shallow bottom portion. This bottom wall portion 31 is formed in such a manner as to slope moderately downwards from an upper portion to a lower portion with respect to the motorcycle as it extends from a front toward a rear thereof with respect to the motorcycle.

Figure 3:
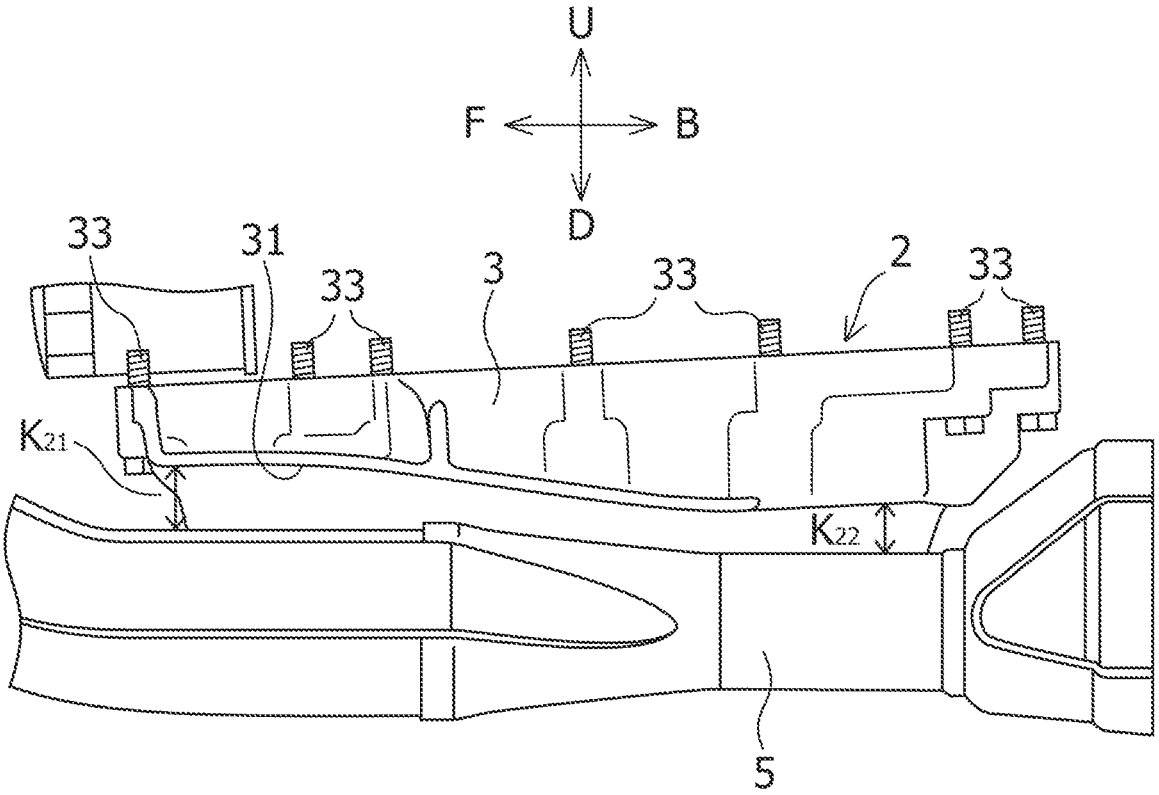
FIG. 3 is a side view of the portion underneath the engine of the motorcycle as viewed from a side of the motorcycle.

Exhaust pipes 5, which are connected to the engine of the motorcycle 1 and through which exhaust gas from the engine flows, are provide below the bottom wall portion 31 of the shallow bottom portion 3 and at sides of both the side wall portions $\mathbf{42}_1$ and $\mathbf{42}_2$ of the deep bottom portion 4 in the left-right direction of the motorcycle. The bottom wall portion 31 of the shallow bottom portion 3 is formed in such a manner as to narrow a space defined in the up-down direction of the motorcycle between the bottom wall portion 31 and the exhaust pipes 5 as the bottom wall portion 31 extends from a front toward a rear thereof with respect to the motorcycle. Specifically, the space $K_{21}$ defined in the up-down direction of the motorcycle between the bottom wall portion 31 and the exhaust pipes 5 at the front of the motorcycle is greater than the space $K_{22}$ defined in the up-down direction of the motorcycle between the bottom wall portion 31 and the exhaust pipes 5 at the rear thereof (FIG. 3).

Figure 4:
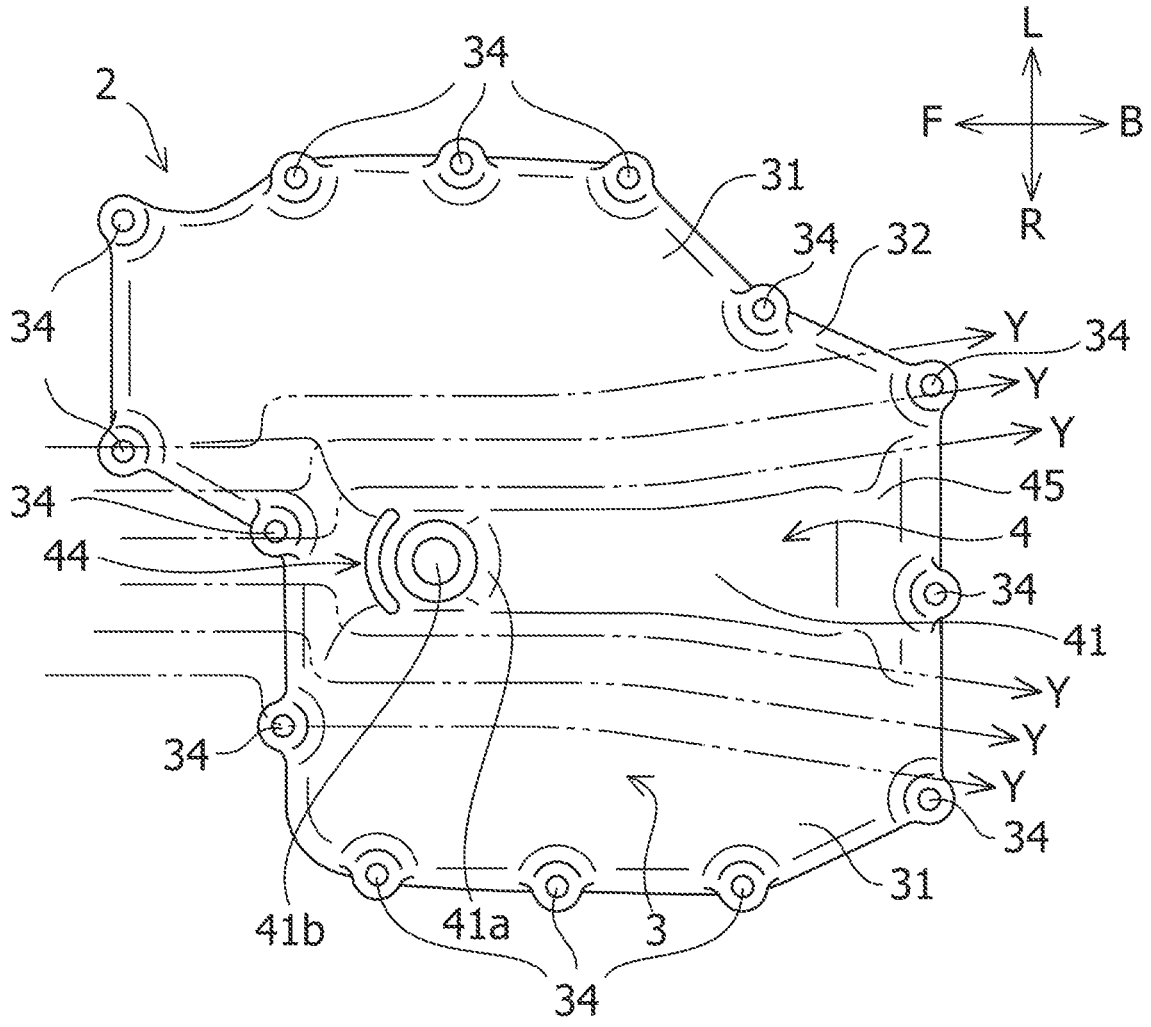
FIG. 4 is a bottom view of an oil pan.
Figure 5:
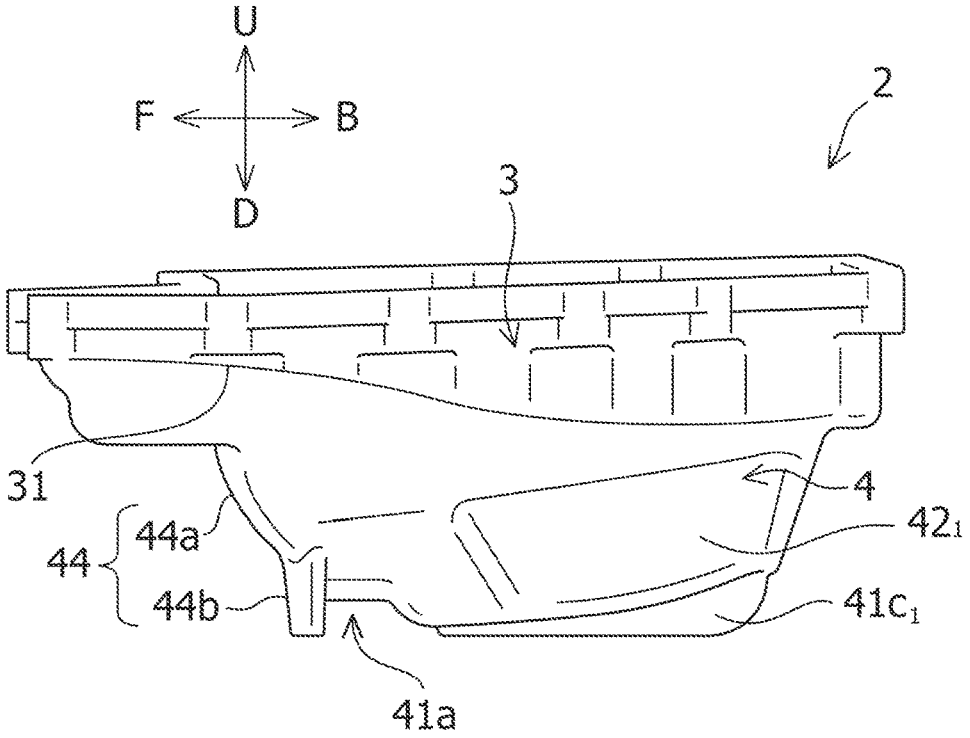
FIG. 5 is a side view of the oil pan.

A flange 32, extending outwards in a substantially horizontal direction, is provided on a circumferential edge portion of the opening portion of the oil pan 2 (that is, the opening portion of the shallow bottom portion 3) (FIG. 4). Through holes 34, through which bolts 33 are inserted to mount the oil pan 2 to the lower portion of the engine of the motorcycle 1, are formed in the flange 32 in such a manner as to penetrate the flange 32 in the up-down direction of the motorcycle (FIGS. 3 and 4).

The temperature of the oil pan 2 is increased as a result of being affected by engine oil while the motorcycle 1 is running. The temperature of the oil pan 2 is increased remarkably at a portion located near the exhaust pipes 5 as a result of being affected by highly heated exhaust gas that flows through the exhaust pipes 5 as well. On the other hand, when the motorcycle 1 is running ahead, at least part of running air that runs from the front to the rear of the motorcycle runs against the wall surface portion 44*b* of the front wall portion 44 of the deep bottom portion 4. At least part of the running air that runs against the wall surface portion 44*b* is divided into two air flows that flow along the sides of both the side wall portions of the deep bottom portion 4 towards the rear of the motorcycle. These two air flows reach the rear portion of the oil pan 2 with respect to the motorcycle while running against both the side wall portions of the deep bottom portion 4 which are formed in such a manner that the space defined therebetween in the left-right direction of the motorcycle at the rear is greater than the space defined therebetween in the left-right direction of the motorcycle at the front. These air flows are indicated as arrows Y.

The portion of the oil pan 2 located close to the exhaust pipes 5 is cooled efficiently by the running air indicated as the arrows Y. Then, heat is transmitted from the flange 32 and the bolts 33 to the relevant portion of the oil pan 2, whereby the flange 32 and the bolts 33 that are located at the rear of the oil pan 2 with respect to the motorcycle are also cooled. As a result, risk of the bolts 33 being loosened can be reduced. Thus, the rear portion of the oil pan with respect to the motorcycle, which is regarded as being hardly struck by running air, can be cooled efficiently.

In this way, according to this embodiment, the oil pan, which is used under the high-temperature environment among the components around the engine of the motorcycle, can be cooled efficiently.

Incidentally, to reduce the weight of the oil pan, base metal such as magnesium or the like is sometimes used as a material for the oil pan. However, the creep strength of magnesium is low in a high-temperature environment, and strain is generated from time to time in a boss portion of the oil pan in association with a difference in linear expansion coefficient between the oil pan and the fastening bolts. Due to this, in the case in which magnesium is used as the material for the oil pan, when the oil pan is used in a highly heated environment, there is a possibility that a reduction in axial force of the fastening bolts is called for in the worst case.

According to the embodiment, since the oil pan is cooled efficiently, generation of strain in the boss portion of the oil pan can be suppressed. As a result of this, the probability of reducing the axial force of the fastening bolts can be decreased.

Further, according to the embodiment, since another component such as a heat shielding plate or the like does not have to be provided for cooling the oil pan, an increase in the number of components to be provided can be suppressed. Hence, the embodiment is advantageous both in productivity and production cost.

Since the lower wall surface portion 44*a* of the front wall portion 44 of the oil pan 2 is formed substantially into an arc shape, running air is allowed to flow to the rear of the oil pan along the wall surface portion with less resistance. As a result of this, the cooling effect can be enhanced further.

At least part of the running air that runs against the wall surface portion 44*b* flows to the rear of the motorcycle underneath the bottom wall portion 41. At this time, the running air flows along the rib portions $\mathbf{41}c_1$ and $\mathbf{41}c_2$ to thereby cool the rib portions $\mathbf{41}c_1$ and $\mathbf{41}c_2$. Since the space defined in the left-right direction of the motorcycle between the rib portions 41$c_1$ and 41$c_2$ at the rear is greater than the space defined in the left-right direction of the motorcycle between both the rib portions at the front thereof, the running air flows to the rear of the motorcycle while flowing on both the rib portions, whereby the rib portions 41$c_1$ and 41$c_2$ are cooled more. Heat at the rear of the oil pan 2 with respect to the motorcycle is transmitted to both the cooled rib portions, as a result of which the cooling effect at the relevant portion can be enhanced further.

Since the bottom wall portion 31 of the shallow bottom portion 3 is formed in such a manner as to slope moderately downwards from the upper portion to the lower portion with respect to the motorcycle as it extends from the front to the rear thereof with respect to the motorcycle, the running air flows to the rear of the motorcycle while running against the outer wall surface of the bottom wall portion of the shallow bottom portion. As a result of this, the cooling effect at the rear portion of the oil pan with respect to the motorcycle can be improved.

As has been described before, the bottom wall portion 31 of the shallow bottom portion 3 is formed in such a manner as to narrow the space defined in the up-down direction of the motorcycle between the bottom wall portion 31 of the shallow bottom portion 3 and the exhaust pipes 5 as the bottom wall portion 31 extends from a front toward a rear thereof with respect to the motorcycle. That is, a cross-sectional area of the space portion between the exhaust pipes 5 and the bottom wall portion 31 in relation to a section perpendicular to the flowing direction of running air is made to decrease as the bottom wall portion 31 extends from the front to the rear of the shallow bottom portion 3. Due to this, the running air passes through the space portion whose cross-sectional area decreases as it extends towards the rear of the motorcycle, whereby the relative speed of the running air to the motorcycle becomes faster towards the rear of the motorcycle. As a result of this, the cooling effect of the rear portion of the oil pan by running air can be increased.

Figure 6:
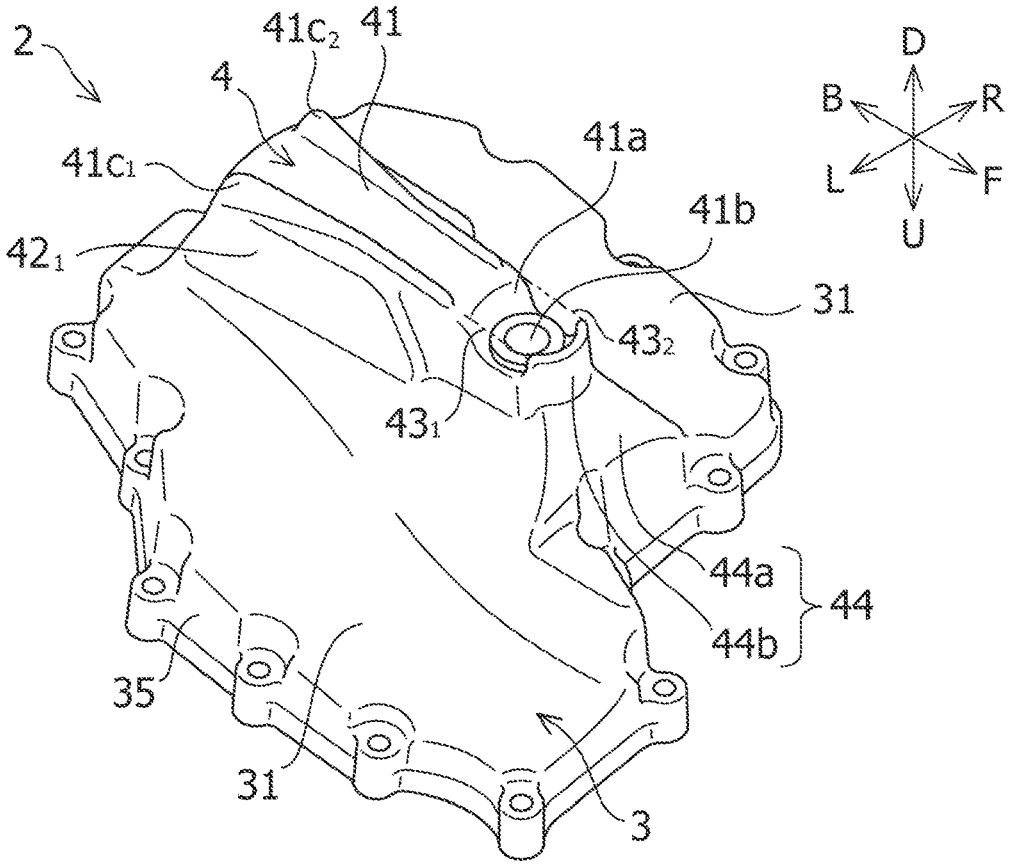
FIG. 6 is a perspective view of the oil pan as viewed from below.

The recess portion 41*a* may not be provided on the bottom wall portion 41. Ridge lines that would be formed by the bottom wall portion 41 and both the left side wall portion 42$_1$ and the right side wall portion 42$_2$ when the recess portion 41*a* is not provided, are indicated as reference numerals 43$_1$ and 43$_2$ (FIG. 6).

Although magnesium can be used as the material of the oil pan, as described before, a magnesium alloy can also be used. Although a wrought material, a casting material and a diecast material may be mentioned as magnesium alloys, any one of them may be used. Aluminum, zinc and an alloy thereof can be used as a material for the oil pan. There is imposed no particular limitation on the constituents of an alloy produced of magnesium, aluminum, zinc and the like.

The space defined in the left-right direction of the motorcycle between both the side wall portions 42$_1$ and 42$_2$ of the deep bottom portion 4 does not have to increase gradually as the deep bottom portion 4 extends from the front to the rear thereof with respect to the motorcycle, and there may be provided on part of the deep bottom portion 4 a portion where both the side wall portions stand parallel to each other. Alternatively, there may be provided on part of the deep bottom portion 4 a portion where the space defined in the left-right direction of the motorcycle between both the side wall portion decreases as the deep bottom portion 4 extends from the front to the rear thereof with respect to the motorcycle.

With the oil pan 2 mounted underneath the engine, a height at a lower end portion of the wall surface portion 44*b* from a road surface can be substantially the same as a height of lower end portions of both the rib portions 41$c_1$ and 41$c_2$ from the road surface. In this case, at least part of running air that flows on the wall surface portion 44*b* to flow to the rear of the motorcycle along the bottom wall portion 41 flows along both the rib portions 41$c_1$ and 41$c_2$. This improves the cooling effect.

The space $K_{11}$ in the left-right direction of the motorcycle of the lower wall surface portion 44*b* of the front wall portion 44 is preferably smaller than a space $K_{41}$ in the left-right direction of the motorcycle of the bottom wall portion at the rear of the recess portion 41*a*. Further, the space $K_{11}$ is preferably greater than the space $K_{31}$. By setting the spaces $K_{11}$, $K_{31}$, and $K_{41}$ in this way, running air hardly escapes to sides of the motorcycle and thereby flows along outer sides of the rib portions 41$c_1$ and 41$c_2$, thereby enhancing cooling efficiency.

Figure 8:
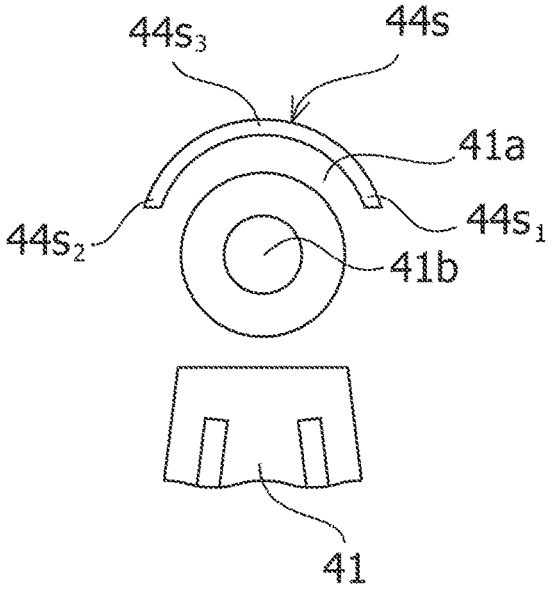
FIG. 8 is an explanatory view illustrating another example of a bottom wall portion of the deep bottom portion of the oil pan.

The wall surface portion 44*b* can be replaced with a wall surface portion 44*s* illustrated in FIG. 8. The wall surface portion 44*s* is formed substantially into an arc shape when seen from below in such a manner that both end portions 44$s_1$ and 44$s_2$ in the left-right direction of the motorcycle are located further rearwards with respect to the motorcycle than a substantially central portion 44$s_3$ in the left-right direction of the motorcycle. Further, the wall surface portion 44*s* is formed in such a manner that a length of an arc thereof is greater than that of the wall surface portion 44*b*.

Figure 9:
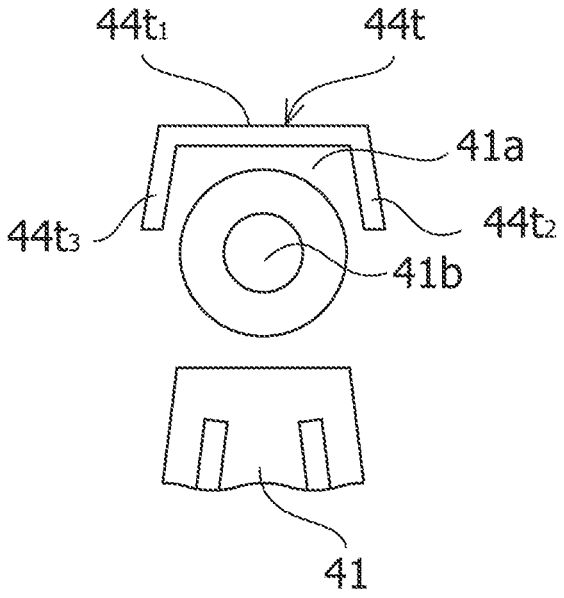
FIG. 9 is an explanatory view illustrating a further example of a bottom wall portion of the deep bottom portion of the oil pan.

Alternatively, the wall surface portion 44*b* can also be replaced with a wall surface portion 44*t* illustrated in FIG. 9. The wall surface portion 44*t* includes a substantially central portion 44$t_1$ in the left-right direction of the motorcycle that extends rectilinearly in the left-right direction of the motorcycle. The wall surface portion 44*t* includes further both end portions 44$t_2$ and 44$t_3$ in the left-right direction of the motorcycle that extend rectilinearly to the rear of the motorcycle from the end portions in the left-right direction of the motorcycle of the substantially central portion 44$t_1$ in the left-right direction of the motorcycle. The wall surface portion 44*t* is formed substantially into a U-shape when seen from below as a whole. When referred to herein, "substantially the U-shape" does not necessarily mean the U-shape exactly, and hence "substantially the U-shape" includes an angular U-shape and a V-shape. "Substantially the U-shape" preferably includes such shapes in which an opening portion expands widely but may include shapes in which an opening portion expands narrowly. As a result, running air is allowed to flow along the wall surface portion to the rear of the oil pan with less resistance, thereby making it possible to further enhance the cooling effect.

The whole of the wall surface portion of the front wall portion 44 (that is, the upper wall surface portion 44*a* and the lower wall surface portion 44*b* with respect to the motorcycle) can also be formed substantially into an arc shape or substantially into a U-shape when seen from below.

The front wall portion 44, both the side wall portions 42$_1$ and 42$_2$, and the rear wall portion 45 of the deep bottom portion 4 can be formed substantially perpendicular in the up-down direction of the motorcycle or can also be formed to be directed inwards of the oil pan as they extend from upper portions to lower portions thereof with respect to the motorcycle.

Thus, although the present invention has been described based on the embodiment thereof, the present invention is not limited to the embodiment that has been described heretofore, and it can be modified or altered variously based on the technical idea of the present invention.

REFERENCE SIGNS LIST

1: motorcycle
2: oil pan
3: shallow bottom portion
31: bottom wall portion
4: deep bottom portion
41: bottom wall portion
41$c_1$, 41$c_2$: rib portion
42$_1$: left side wall portion
42$_2$: right side wall portion
44: front wall portion
5: exhaust pipe

The invention claimed is:

1. An oil pan disposed underneath an engine of a motorcycle and configured to reserve engine oil, comprising: a shallow bottom portion; and a deep bottom portion formed to extend in a front-rear direction of the motorcycle substantially at a center in a left-right direction of the motorcycle of the shallow bottom portion and to become deeper than the shallow bottom portion and in which a space defined in the left-right direction of the motorcycle between both side wall portions of the deep bottom portion that face each other in the left-right direction of the motorcycle is formed to continuously increase as the deep bottom portion extends from a front toward a rear thereof with respect to the motorcycle, wherein an exhaust pipe connected to the engine of the motorcycle is disposed below the bottom wall portion of the shallow bottom portion and on a side in the left-right direction of the motorcycle of a side wall portion of the deep bottom portion, and wherein the bottom wall portion of the shallow bottom portion is formed to narrow a space defined in the up-down direction of the motorcycle between the bottom wall portion of the shallow bottom portion and the exhaust pipes as the bottom wall portion of the shallow bottom portion extends from the front to the rear thereof with respect to the motorcycle.

2. The oil pan according to claim 1, wherein at least a lower wall surface portion with respect to the motorcycle of a front wall portion of the deep bottom portion is formed substantially into an arc shape or substantially into a U-shape when seen from below in which both end portions in the left-right direction of the motorcycle are located further rearwards with respect to the motorcycle than a substantially central portion in the left-right direction of the motorcycle.

3. The oil pan according to claim 1, wherein two rib portions are provided on a bottom wall portion of the deep bottom portion, the two rib portions protruding downwards with respect to the motorcycle and extending in the front-rear direction of the motorcycle.

4. The oil pan according to claim 1, wherein a bottom wall portion of the shallow bottom portion is formed to moderately slope downwards from an upper portion to a lower portion thereof with respect to the motorcycle as the bottom wall portion extends from a front toward a rear thereof with respect to the motorcycle.

* * * * *